US008755678B2

(12) United States Patent
Dykman

(10) Patent No.: US 8,755,678 B2
(45) Date of Patent: Jun. 17, 2014

(54) EXPLOSION PROOF FORCED AIR ELECTRIC HEATER

(76) Inventor: Arjan Dykman, Airdrie (CA)

( * ) Notice: Subject to any disclaimer, the term of this patent is extended or adjusted under 35 U.S.C. 154(b) by 165 days.

(21) Appl. No.: 13/164,958

(22) Filed: Jun. 21, 2011

(65) Prior Publication Data

US 2012/0328270 A1 Dec. 27, 2012

(51) Int. Cl.

| | |
|---|---|
| ***F24H 3/02*** | (2006.01) |
| ***F24H 3/10*** | (2006.01) |
| ***H05B 3/08*** | (2006.01) |
| ***H05B 3/50*** | (2006.01) |

(52) U.S. Cl.
USPC ..... 392/360; 392/363; 219/541

(58) Field of Classification Search
None
See application file for complete search history.

(56) References Cited

U.S. PATENT DOCUMENTS

| | | | | | |
|---|---|---|---|---|---|
| 1,358,059 | A | * | 11/1920 | Clutts | 392/365 |
| 1,998,916 | A | * | 4/1935 | Young et al. | 392/365 |
| 2,007,222 | A | * | 7/1935 | Soverhill | 392/360 |
| 2,080,797 | A | * | 5/1937 | Wiegand | 392/360 |
| 2,080,798 | A | * | 5/1937 | Wiegand | 392/360 |
| 2,080,799 | A | * | 5/1937 | Wiegand | 337/356 |
| 2,085,772 | A | * | 7/1937 | Soverhill | 392/365 |
| 2,158,605 | A | * | 5/1939 | Wiegand | 392/365 |
| 2,170,174 | A | * | 8/1939 | Wiegand | 219/540 |
| 2,230,440 | A | * | 2/1941 | Wiegand | 392/360 |
| 2,237,569 | A | * | 4/1941 | Lofgren | 219/628 |
| 2,296,185 | A | * | 9/1942 | Rose | 237/17 |
| 2,590,336 | A | * | 3/1952 | Mast | 392/370 |
| 3,061,706 | A | * | 10/1962 | Lundbom | 392/349 |
| 3,176,117 | A | * | 3/1965 | Knoll et al. | 392/360 |
| 3,534,197 | A | * | 10/1970 | Burnett | 219/628 |
| 3,870,860 | A | * | 3/1975 | Steiner | 392/351 |
| 4,117,308 | A | * | 9/1978 | Boggs et al. | 392/360 |
| 4,124,794 | A | * | 11/1978 | Eder | 219/530 |
| 4,518,847 | A | * | 5/1985 | Horst et al. | 392/358 |
| 5,278,936 | A | * | 1/1994 | Shao | 392/365 |

* cited by examiner

*Primary Examiner* — Joseph M Pelham
(74) *Attorney, Agent, or Firm* — Arjan Dykman

(57) ABSTRACT

An explosion proof forced air electric heater is designed to supply heat to hazardous areas where the atmosphere contains readily combustible gases, vapors or dust particles. The heater employs an air mover which forces air through a metal heat sink with strategically placed electric heating elements. The terminal ends of the heating elements extend into a sealed and encapsulated explosion proof containment chamber which is connected to a centralized explosion proof enclosure. The explosion proof enclosure contains the control features and the electrical connections of the heater along with external accessories. The heating cycle is controlled via an electronic control circuit. The electronic circuit controls the process heating temperature, air mover operation, heating element operation, temperature measuring device operation, and monitors the total operation time of the heating elements while providing process failure feed back to the operator.

20 Claims, 14 Drawing Sheets

—— TEMPERATURE MONITORING DEVICE PATTERN
-·-·- PRESENT INVENTION AMBIENT TEMPERATURE PATTERN
-·-·- PRIOR ART HEATING MEDIA TEMPERATURE PATTERN
-·-·- PRIOR ART AMBIENT TEMPERATURE PATTERN

Section A - A

EXPLOSION PROOF FORCED AIR ELECTRIC HEATER

BACKGROUND OF THE INVENTION

1. Field of the Invention

The present invention relates to an improved explosion proof forced air electric heater. The heaters are primarily used for heating hazardous environments where the incidences of fire or explosion are increased due to the presence of flammable gases, vapors, or liquids; combustible dust particles, filings, or ignitable fibers. Furthermore, the heaters can similarly be used to heat non-hazardous environments.

2. Prior Art

Explosion proof forced air electric heaters have been on the market since the 1970's under U.S. Pat. No. 4,117,308. The majority of the forced air electric heaters currently in use rely upon a liquid filled heat exchanger. (See U.S. design Pat. No. D 356,367). These heat exchangers are generally comprised of three main components: (1) a steel bottom header; (2) steel tubes with roll formed aluminum fins; and (3) a steel top header, which houses a pressure relief valve. The bottom header contains the electric heating source, which is typically a tubular electric resistant element submerged in a glycol water mixture within the cavity of the bottom header. The prior art's heat transfer process is initiated by supplying the electric heating elements with electricity. The electricity is converted into heat, thereby increasing the temperature of the glycol water mixture to its boiling point, thus creating glycol steam, which rises through the steel tubes and into the top header. The heat is then conducted to the steel tubes and transferred to the roll formed aluminum fins where an air mover forces cool air over the fins to distribute the heat. The heating cycle is repeated when the glycol steam cools and reverts back to the bottom header in liquid form for reheating. The heat exchanger is typically vacuum charged to reduce the resistance exerted upon the glycol steam and to allow for even heat distribution during the cycle. The prior art's safety mechanisms include: the top header's pressure relief valve, which protects the heat exchanger in the event pressure limits are exceeded; and the high limit temperature switch imbedded in the bottom header, which cuts power to the electric heating elements and air mover should the system overheat.

The prior art is typically controlled by a thermostatic switch which monitors the ambient or desired environmental temperature. A call for heat typically activates a switch that engages a mechanical contactor, thereby triggering the electric heating elements and air mover simultaneously. Once the demanded temperature is achieved, the switch disengages the mechanical contactor and immediately turns off the electric heating elements and air mover.

The prior art's typical explosion proof forced air heaters have proven themselves reliable, however, the manner with which they transfer electric heat into the atmosphere and the lack of controllability thereof suggests several key short comings in the current design.

SUMMARY OF THE INVENTION

The present invention is designed to improve the performance and controllability of explosion proof forced air electric heaters.

The present invention is a liquid free dry heat exchanger. The dry heat exchanger is comprised of a top header and bottom header with a heat exchanger coupled between the headers. The heat exchanger contains high heat conductive metal tubes with press fit high heat conductive metal fins. The heating source of the unit is assembled by mounting electric heating elements within the metal tubes. The bottom and top headers are then press fit on either end of the metal tubes to form an electrical enclosure on either end of the heating elements.

The present invention is an electronically controlled heating system that makes use of an electronic control circuit to control and monitor the electric heating elements, air mover, operating temperature, internal enclosure temperature and hi limit switch. The heating cycle begins when there is a demand for heat which engages a thermostatic switch, activating the electronic control circuit. The electronic control circuit then uses a solid state relay to momentarily engage the air mover to ensure it is in working condition before engaging the heat source. A current transformer device assesses the air mover's functionality and sends a signal to the electronic control circuit to either engage the electric heating elements if the air mover is operational, or terminate the startup cycle if the air mover is not working. Upon confirmation the air mover is operational, the electronic control circuit switches a solid state relay to engage the electric heating elements. Once the elements heat the heat exchanger to a predetermined temperature, the electronic control circuit re-engages the air mover, drawing cool air through the intake opening, over the heated metal fins and out the exhaust opening into the atmosphere. A temperature monitoring device mounted in the heat exchanger continuously monitors the exchanger's temperature to ensure the air mover is not prematurely activated before the fins are sufficiently heated. The heating elements remain engaged until the demand for heat is met, at which point the thermostatic switch disengages and signals the electronic control circuit to disconnect power leading to the electric heating elements. The air mover remains engaged until the heat exchanger has sufficiently cooled, at which time the temperature monitoring device sends a signal to the electronic control circuit disengaging the air mover and completing the heating cycle. In the event the heater overheats, a hi limit monitoring device mounted in the heat exchanger signals the electronic control circuit to disconnect power leading to the electric heating elements and air mover simultaneously in order to safely shutdown the heat exchanger. Unlike the present invention, the prior art typically uses mechanical relays to control the heater, and the electrical heating elements and air mover are engaged or disengaged simultaneously when there is a demand for heat or when the demanded temperature has been met.

The present invention heats the surrounding environment via two distinct heat transfer phases. Initially, the electric heating element is supplied with an electrical current which heats the heat exchanger that is comprised of heat conductive metal tubes and fins. An air mover then transfers and distributes this heat from the tubes and fins into the surrounding environment by forcing cool air over the heat exchanger. Unlike the present invention's dual transfer theory, the prior art employs a less efficient design by requiring five distinct heat transfer phases to occur. The prior art initially transfers heat from (1) the electric heating elements to a glycol and water mixture. (2) As the mixture's temperature increases it is converted from a liquid into steam. (3) The steam's heat is then transferred to the steel tubes. Finally, (4) the steel tubes transfer their heat to the aluminum fins, at which time (5) the heat is distributed from the fins into the surrounding environment by an air mover.

During the present invention's heating cycle the heat exchanger increases in temperature proportionately to the ambient air's entering temperature. As a result, the ambient air could reach an elevated temperature where the heat exchanger risks reaching its hi limit temperature before the demanded temperature has been met, triggering the hi limit safety mechanism and initiating premature shutdown of the unit. To mitigate this scenario, the present invention's electronic control circuit controls a cycling event whereby the electric heating elements are intermittently switched on and off at predetermined temperature ranges until the demanded temperature has been met, completing the heating cycle.

The electronic control circuit of the present invention has several fail safe safety mechanisms which will shut the heater down by disconnecting the power leading to the electric heating elements and air mover. The scenarios that will elicit a safe shut down include but are not limited to the electronic control circuit failing to register a predetermined current from the: air mover, electric heating elements, operating temperature monitoring device, internal enclosure hi temperature limit, or the heat transfer hi limit temperature switch. In the event the heat exchanger overheats, the hi limit temperature monitoring device sends a signal to the electronic control circuit indicating the preset hi limit temperature has been exceeded, forcing immediate shutdown. The prior art's fail-safe safety mechanisms typically use a preset hi limit temperature switch placed in series with the thermostat switch, therefore the mechanical relay stays engaged until the hi limit temperature switch disengages, disconnecting power leading to the electric heating elements and the air mover. Certain systems have also provided a high ambient preset temperature device positioned in the explosion proof enclosure box. Apart from the previously mentioned safety devices, no other form of safety shut down and/or monitoring features have been applied to the previous art.

The present invention also has an integral disconnect switch built directly into the explosion proof enclosure box. This disconnect switch is an added safety feature which allows the heater to be fully disconnected from the power source and locked out, by means of a pad lock, during routine maintenance. The previous art only provides this option on specialty models where a separate enclosure and added conduit is required, thereby increasing installation complexity and the total mass of the heating unit.

Further objects and advantages of the invention will become apparent from the following description read together with the accompanying drawings.

BRIEF DESCRIPTION OF THE DRAWINGS

For a better understanding of the present invention, aspects of the invention demonstrating the concepts of the present invention are illustrated, by way of example, in the enclosed Figures in which.

DESCRIPTION OF THE DRAWINGS AND OF THE PREFERRED EMBODIMENT

Figure 1:
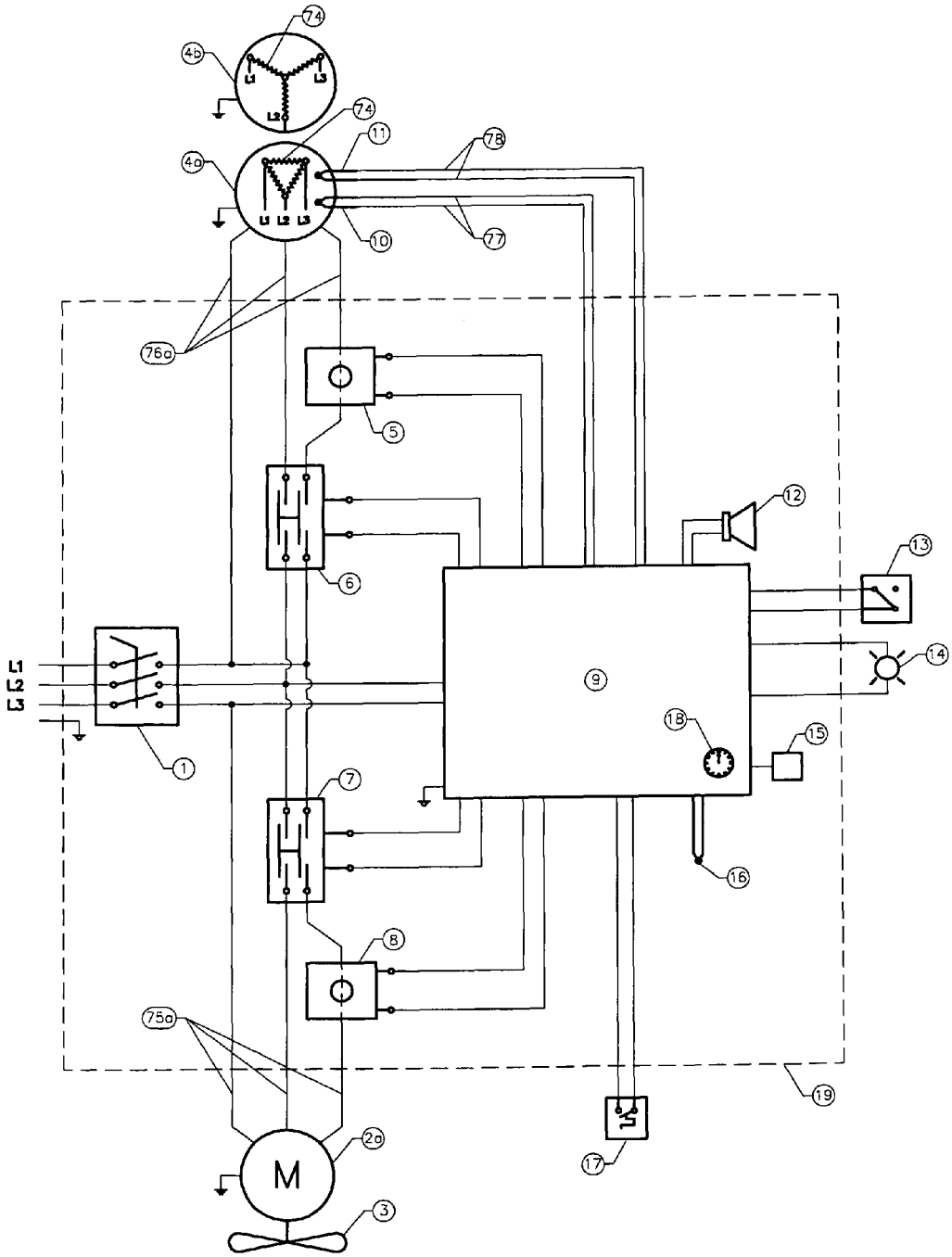
FIG. 1 is a schematic drawing showing a preferred three phase electronic control system of the present invention.

The present invention may be embodied in a number of different forms. The specifications and drawings that follow describe and disclose only some of the specific forms of the invention and are not intended to limit the scope of the invention as defined in the claims that follow herein.

With reference to FIGS. 1, 2, 3 and 13, an explosion proof forced air electric heater according to the present invention operates in the following preferable operating sequence.

The typical heat cycle is preferably started by a thermostatic switch 17 enabling the electronic control circuit 9 to perform a preprogrammed heating cycle. The air mover 3 is preferably mounted to the electric motor 2*a* (three phase power), or 2*b* (single phase power) and is engaged by switching a preferred solid state relay 7 momentarily, at a preferably set predetermined current value to determine the working condition of the air mover, by transmitting a signal from a preferred electrical motor current transformer device 8 to the electronic control circuit 9. The electronic control circuit 9 engages the electric heating elements within the heat exchanger 4*a* (three phase delta power), 4*b* (three phase star power) or 4*c* (single power) by switching a preferred solid state relay 6. The electric heating elements 74 within the heat exchanger 4*a*, 4*b*, 4*c* are continuously monitored preferably by a current transformer device 5 that transmits a signal to the electronic control circuit 9. A preferable temperature sensing device 10 monitors the operating temperature of the electric heating elements within the heat exchanger 4*a*, 4*b*, 4*c*. The heat exchanger 4*a*, 4*b*, 4*c* will heat to a predetermined temperature and once the temperature has been met, the electric motor 2*a*, 2*b* is engaged by switching preferably a solid state relay 7. Engagement of the electric motor 2*a*, 2*b* draws cooler air through the intake opening 72 and forces the cooler air over the electric heating elements 74 within the heat exchanger 4*a*, 4*b*, 4*c* and pushes warm air through the exhaust opening 73 into the atmosphere. Once the demanded ambient temperature has been reached, the thermostatic switch 17 disengages, followed by the electronic control circuit 9 disengaging the solid state relay 6, which disconnects the power leading to the electrical heating elements 74 within the heat exchanger 4*a*, 4*b*, 4*c*. The electric motor 2*a*, 2*b* stays engaged and the air mover 3 operates until the heat exchanger 4*a*, 4*b*, 4*c* has cooled to a predetermined set temperature, as monitored by the temperature sensing device 10. The cooling of the heat exchanger 4*a*, 4*b*, 4*c* completes the heating cycle and is illustrated in graphic format as per FIG. 3: "Preferred Heating Cycle". During the heat cycle, the electric motor 2*a*, 2*b* is continuously monitored preferably by an electric motor current transformer device 8. The temperature monitoring device 11 is the hi limit safety device which commands the electronic control circuit 9 to disconnect the power leading to the electric heating elements 74 within the heat exchanger 4*a*, 4*b*, 4*c* and the electric motor 2*a*, 2*b* should the heat exchanger 4*a*, 4*b*, 4*c* overheat. In the event there is a demand for heat within an environment where the ambient temperature is already elevated, the heat exchanger 4*a*, 4*b*, 4*c* could potentially reach the hi limit temperature and initiate a forced shutdown prior to reaching the demanded temperature. To avoid premature shutdown the electronic control circuit 9 automatically triggers an oscillating cycle, whereby, the heat exchanger 4*a*, 4*b*, 4*c* cycles between a predetermined upper and lower temperature limit, as monitored by the temperature monitoring device 10. The oscillating cycle continues until the demanded temperature has been met and the heating cycle is complete. This oscillating concept enables the heater to maintain maximum forced air output levels at all times within the capabilities of the present invention. The oscillating cycle described above is illustrated in graphic form by FIG. 3: "Preferred Elevated Ambient Heating Cycle," while the heating cycle of the prior art is similarly included for comparison purposes.

Preferably a switch 13 provides the option of controlling the electric motor 2*a*, 2*b* with an air mover 3 operating in either a preferable "automatic on" selection mode or "continuous on" selection mode. Under the "automatic on" selection mode the electric motor 2*a*, 2*b* operates according to the preprogrammed heating cycle. Conversely, under the "continuous on" selection mode the electric motor 2*a*, 2*b* runs continuously providing mere air movement as part of a cooling cycle.

A preferably explosion proof enclosure 19 houses potential explosion causing devices and the enclosure internal predetermined hi limit temperature monitoring device 16, which monitors the internal temperature within the explosion proof enclosure 19.

Events eliciting the safety mechanisms of the preferred embodiment are listed below in paragraphs (a) through (h), but not limited to events (a) through (h). Should either of these events described below occur, the power leading to the electric heating elements 74 within the heat exchanger 4*a*, 4*b*, 4*c* and the electric motor 2*a*, 2*b* will be disconnected, thereby, shutting down the heater. The heater shutdown will then preferably be relayed to the operator by preferably providing a predetermined sequenced audible beep through a preferably audible beeping device 12 or by preferably providing a predetermined sequenced blinking by a preferably illumination device 14. The heater will shut down if:

a) the electronic control circuit 9 does not register a predetermined electrical current from the electric motor current transformer device 8 during the heat exchanger 4*a*, 4*b*, 4*c* warm up, due to failure of the: electric motor 2*a*, 2*b*; electric motor current transformer device 8; or solid state relay 7;

b) the electronic control circuit 9 does not register a predetermined electrical current from the electric motor current transformer device 8 during the normal heat cycle, due to failure of the: electric motor 2*a*, 2*b*; electric motor current transformer device 8; or solid state relay 7;

c) the electronic control circuit 9 does not register a predetermined electrical current from the electric heating element current transformer device 5 due to failure of the electric heating element within the heat exchanger 4*a*, 4*b*, 4*c*; electric heating element current transformer device 5; or solid state relay 6;

d) the electronic control circuit 9 does not register a signal from the operating temperature monitoring device 10 due to device failure;

e) the electronic control circuit 9 does not register a signal from the hi limit safety temperature monitoring device 11 due to device failure;

f) the electronic control circuit 9 registers a signal from the hi limit safety temperature monitoring device 11 indicating the heat exchanger 4*a*, 4*b*, 4*c* has reached the predetermined hi limit temperature and is overheating;

g) the electronic control circuit 9 does not register a signal from the enclosure internal predetermined hi limit temperature monitoring device 16 due to device failure;

h) the electronic control circuit 9 registers a signal from the enclosure internal predetermined hi limit temperature monitoring device 16 indicating the explosion proof enclosure 19 has reached the predetermined internal predetermined hi limit temperature and is overheating.

Communication port 15 provides an interface to the electric control circuit 9, where the operator can upload and test heating cycle software or remotely operate the heater.

A preferred built-in time monitoring device 18 provides feedback for the operator pertaining to the amount of time the electrical heating elements 74 within the heat exchanger 4*a*, 4*b*, 4*c* have been engaged.

In order to safely perform maintenance on the preferred embodiment of the present invention, an integral disconnect switch 1 can be disconnected and locked out to eliminate power leading to the entire unit. This switch also functions as a reset device through its disconnection and re-connection of power leading to the electronic circuit 9, thereby clearing the safety event.

The solid state relay 6, 7 can be substituted for an electrical mechanical relay.

With reference to the drawings and in particular, FIGS. 1, 2, 4-10, the preferred embodiment of the present invention is comprised of a top and bottom panel 20 which is bolted to the right side panel 21 and left side panel 22, as well as the shroud panel 23. Panel's 20, 21, 22 and 23 form the heater cabinet and are all preferably manufactured of sheet metal. A preferably explosion proof electric motor 24 is then preferably bolted to the motor mount 25, which is preferably bolted to the explosion proof junction box mount bracket 26 and the motor mount bracket 27. Similarly, the mount brackets 25, 26, 27 are preferably formed of sheet metal and are all preferably bolted to the cabinet. An axial air mover 28 preferably constructed of non-sparking materials is secured to the shaft of the explosion proof electric motor 24, however, the axial air mover 28 can be substituted with any type of air mover. The axial air mover 28 is centered on the shroud panel 23 and an axial mover guard 29, preferably constructed of metal wire, is preferably bolted to the shroud panel 23. An explosion proof expansion conduit union "A" represented by members 30 and 31, preferably manufactured from non-sparking metal, whereby explosion proof expansion conduit union member 30 is threaded onto the electric motor connection 24*a*. The explosion proof expansion conduit union member 31 preferably axial telescoping inside the explosion proof expansion conduit union member 30, preferably manufactured from non-sparking metal, and is preferably threaded into the explosion proof junction box 32 which is preferably constructed of a non-sparking metal. The explosion proof junction box 32 is preferably bolted to the explosion proof junction box mount bracket 26 and has a explosion proof junction box cover 33, preferably constructed of a non-sparking metal, and preferably bolted to the explosion proof junction box 32. The explosion proof junction box 32 may hold a built in thermostatic switch 17 as per FIGS. 1 and 2, as opposed to a preferred explosion proof junction box cover 33.

An expansion conduit union "B", represented by members 34 and 35, preferably manufactured from a non-sparking metal, whereby explosion proof conduit member 34 is preferably threaded into the explosion proof junction box 32 and the explosion proof expansion conduit union member 35 is preferably axially telescoping over the explosion proof expansion conduit union member 34, preferably manufactured from a non-sparking metal and is preferably threaded into the explosion proof enclosure box 36, preferably constructed of a non-sparking metal.

Figure 2:
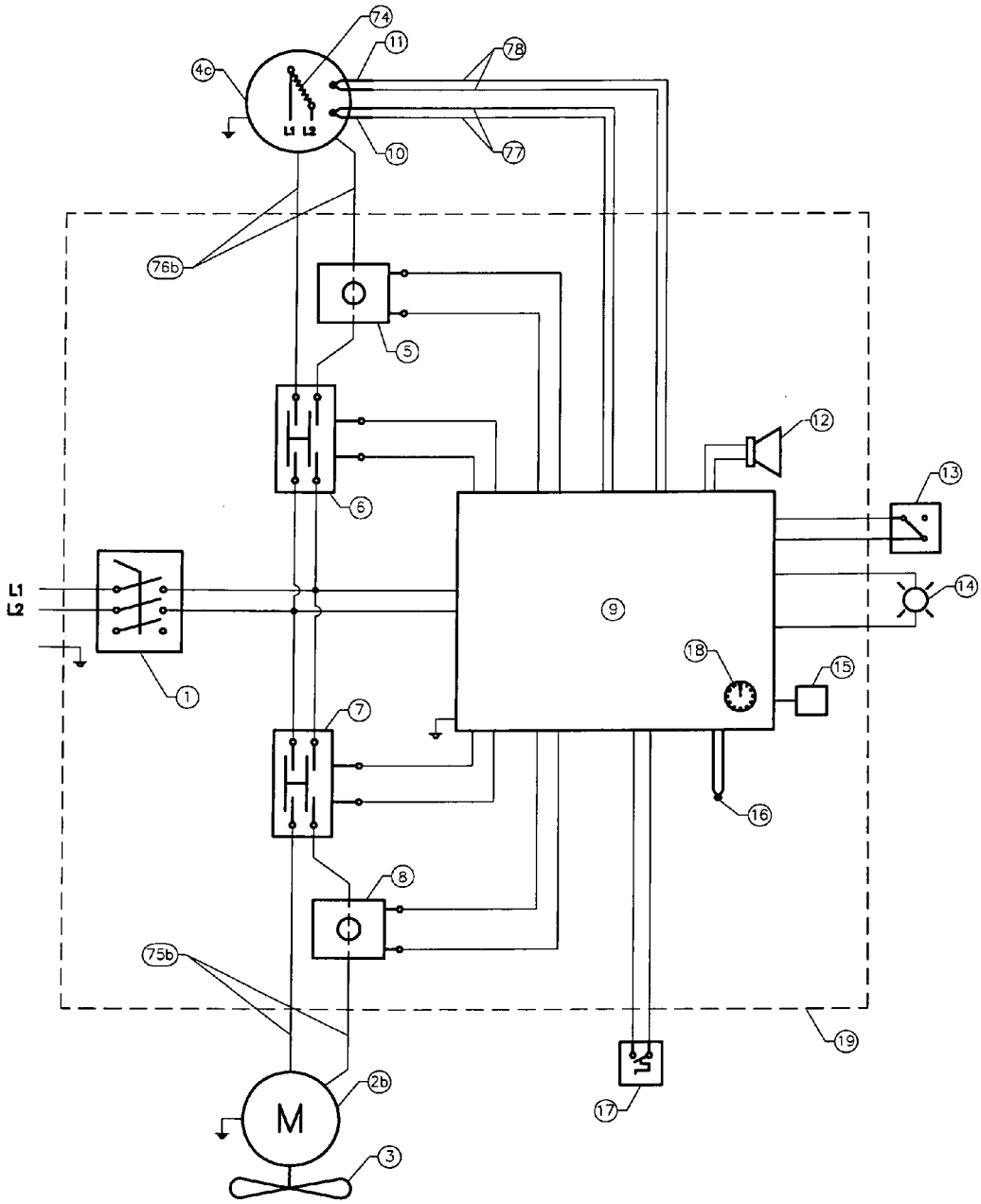
FIG. 2 is a schematic drawing showing a preferred single phase electronic control system of the present invention.
Figure 3:
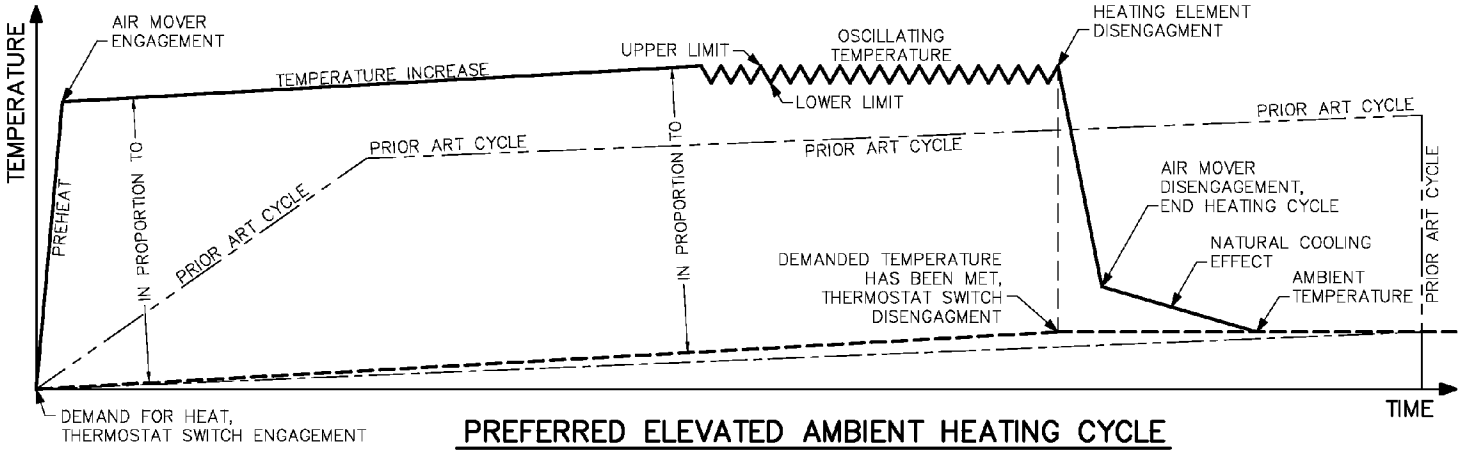
FIG. 3 illustrates a preferred heating cycle of the present invention in graphic format.
Figure 3:
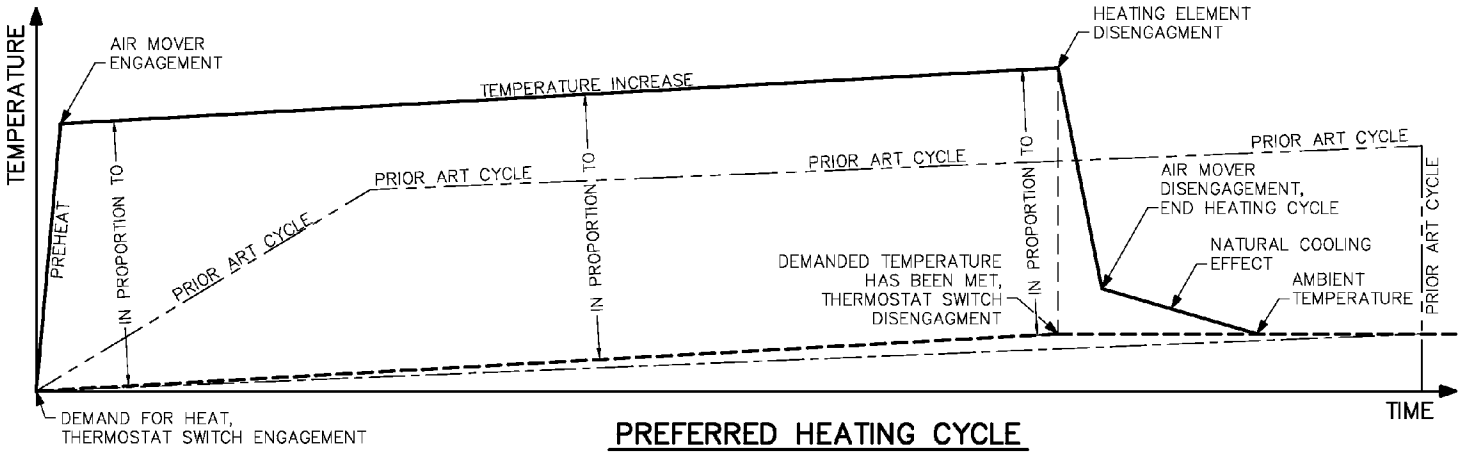
Figure 4:
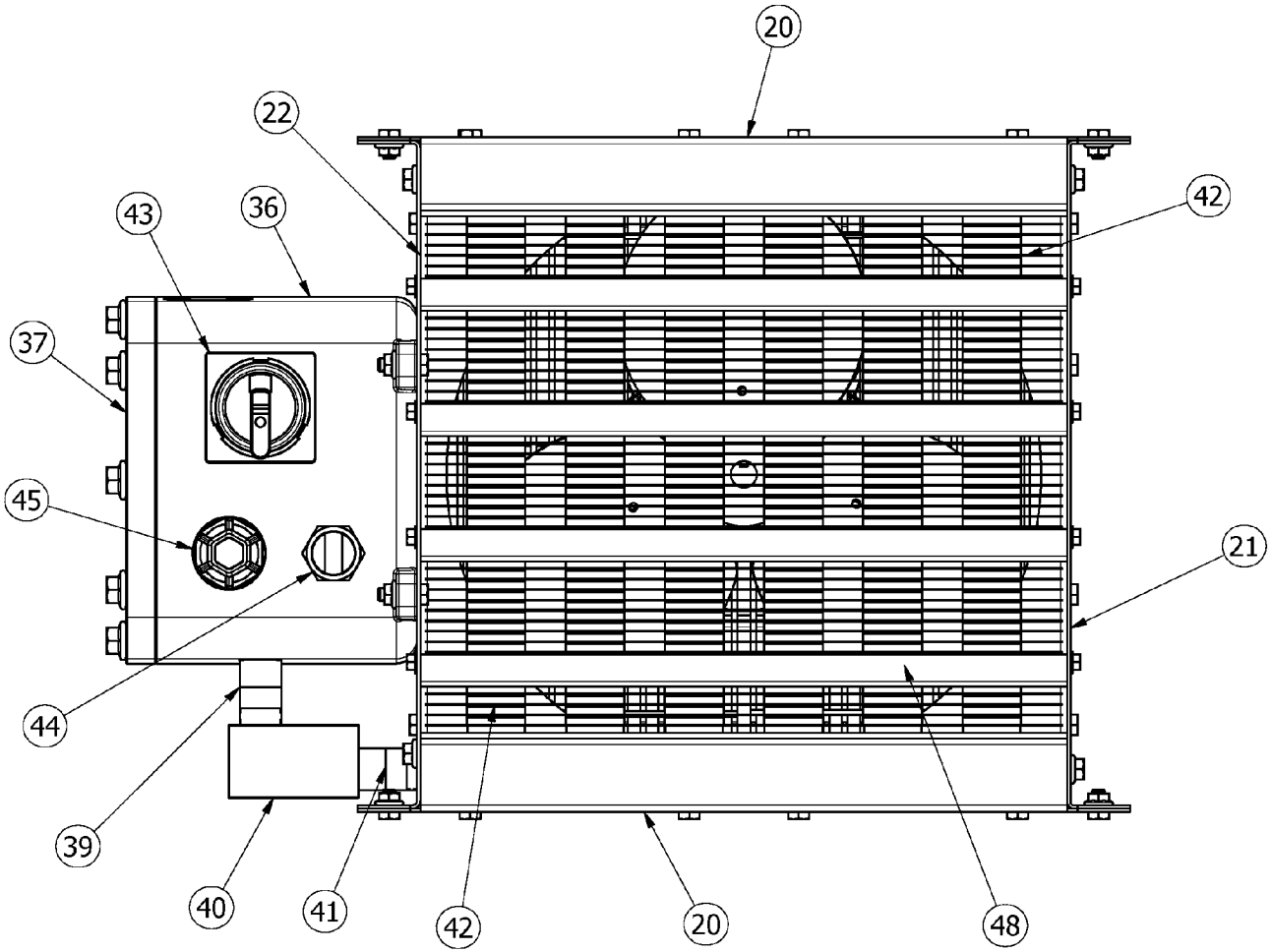
FIG. 4 is a front face view showing a preferred embodiment of the present invention.
Figure 5:
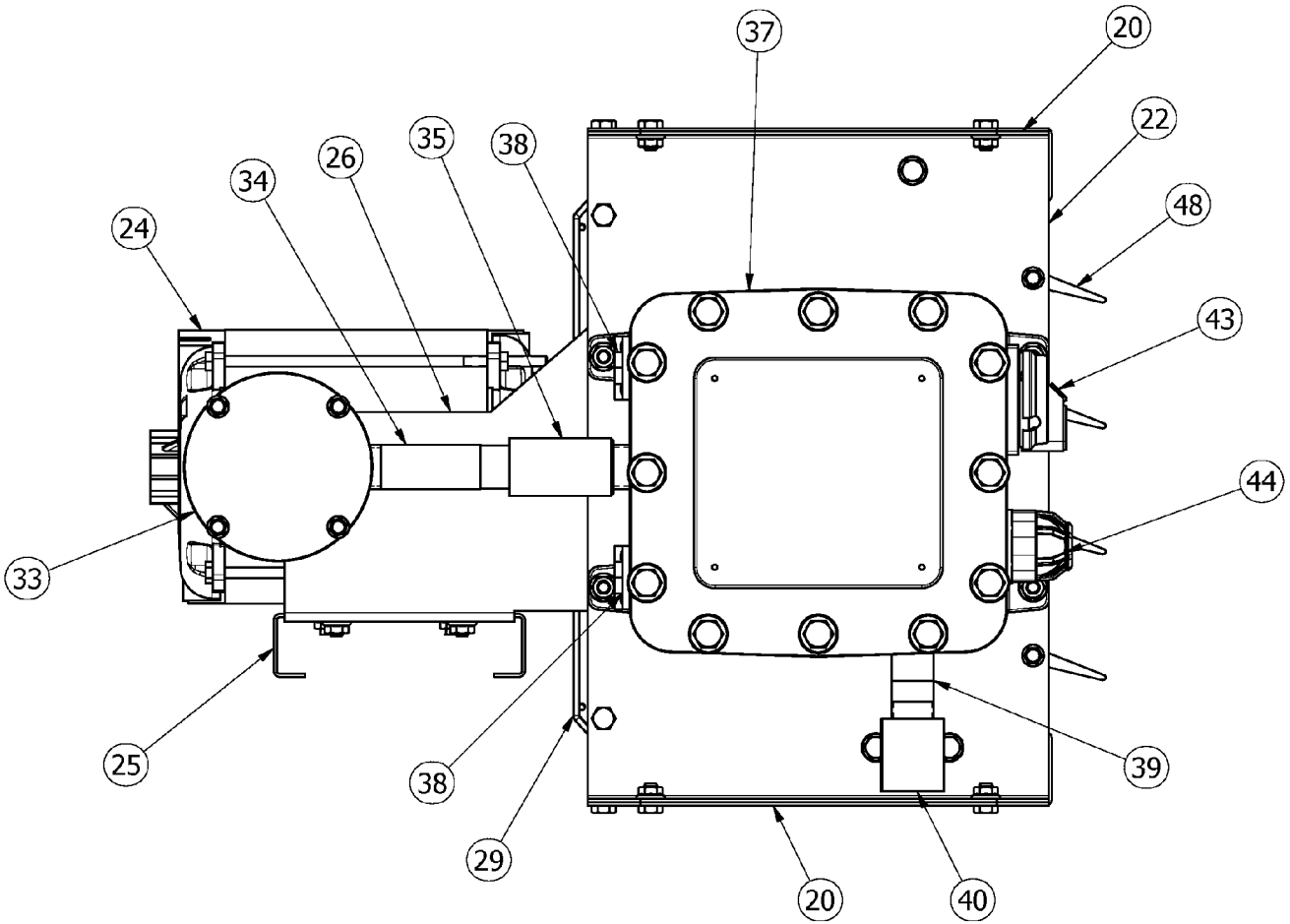
FIG. 5 is a left hand side view thereof.
Figure 6:
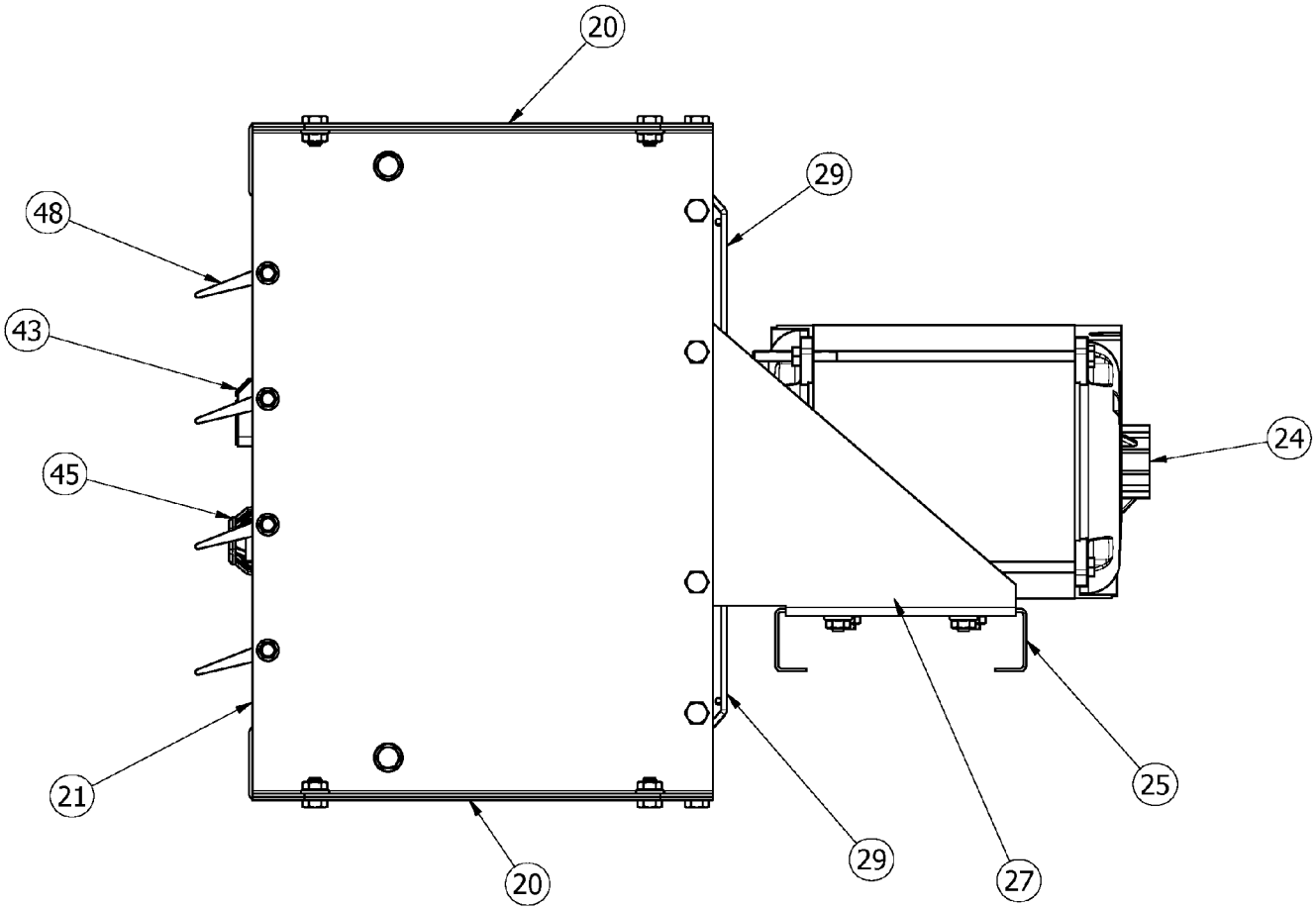
FIG. 6 is a right hand side view taken generally on line 6-6 of FIG. 4.
Figure 7:
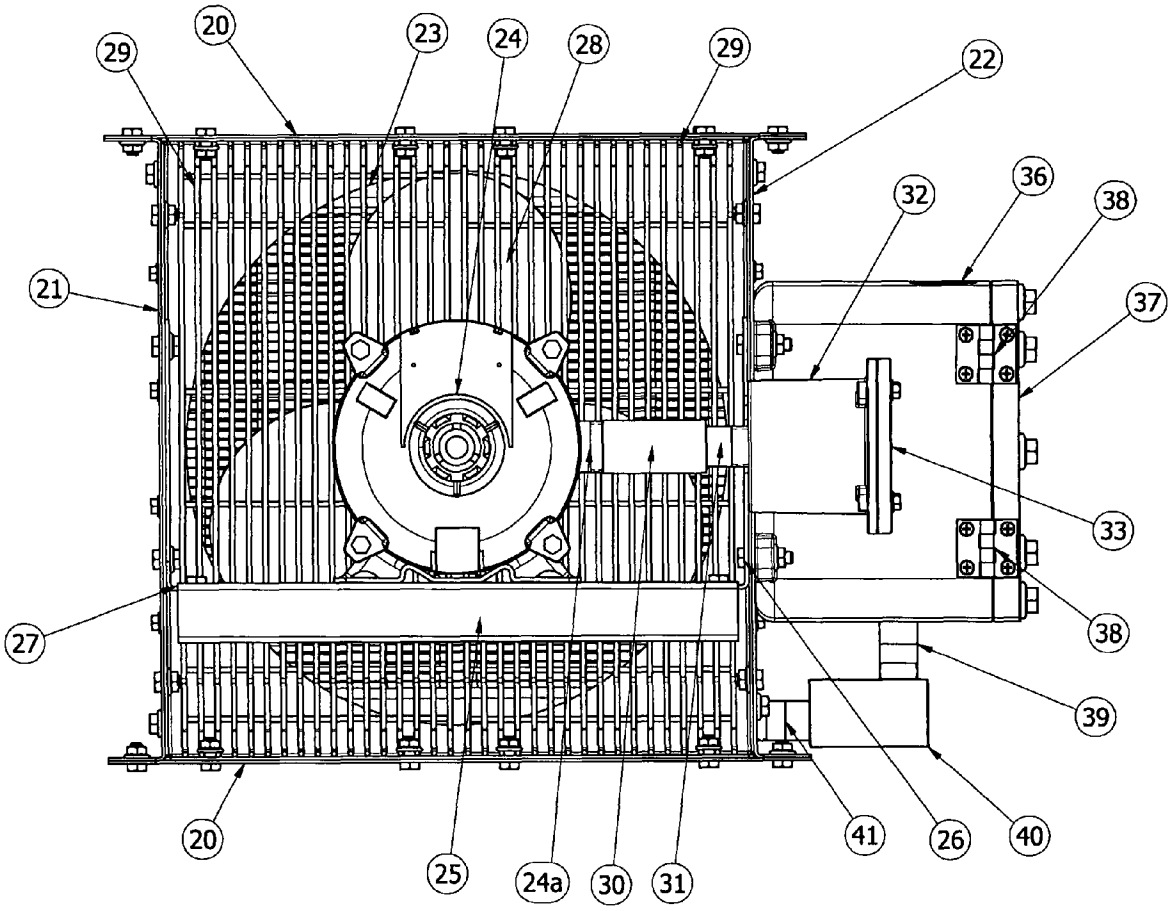
FIG. 7 is a rear side view taken generally on line 7-7 of FIG. 4.
Figure 8:
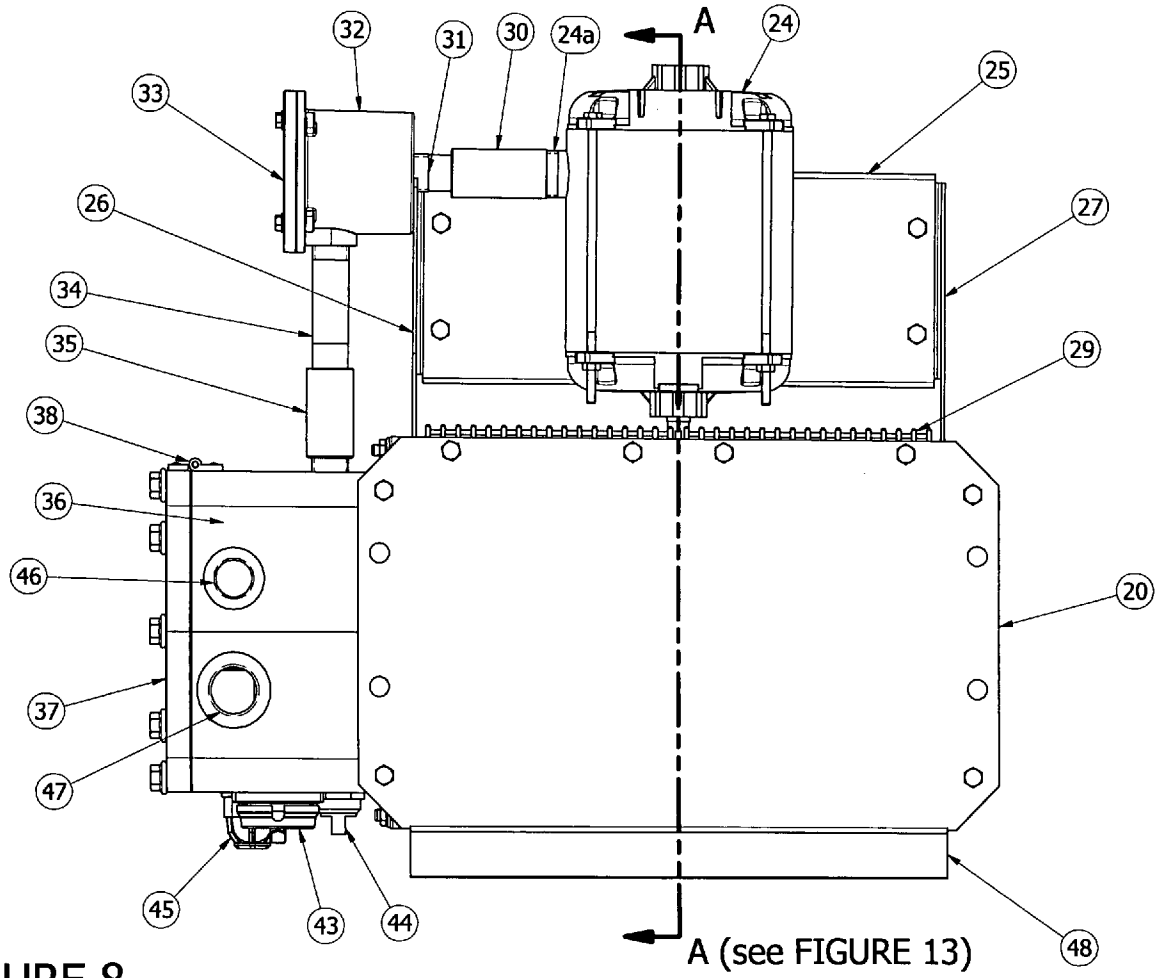
FIG. 8 is a top view taken generally on line 8-8 of FIG. 4.
Figure 9:
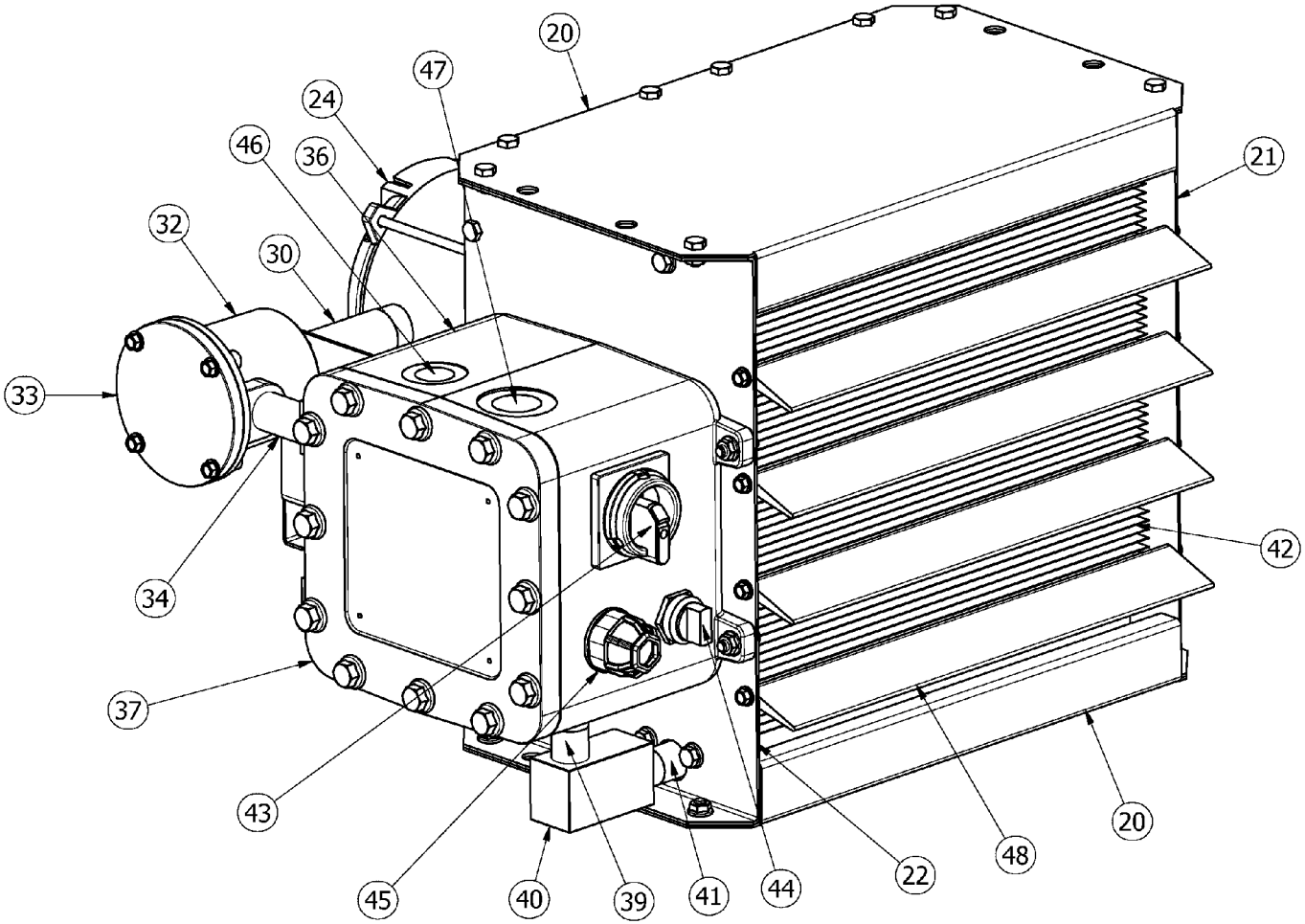
FIG. 9 is a perspective view from the front side of a preferred embodiment of the present invention.
Figure 10:
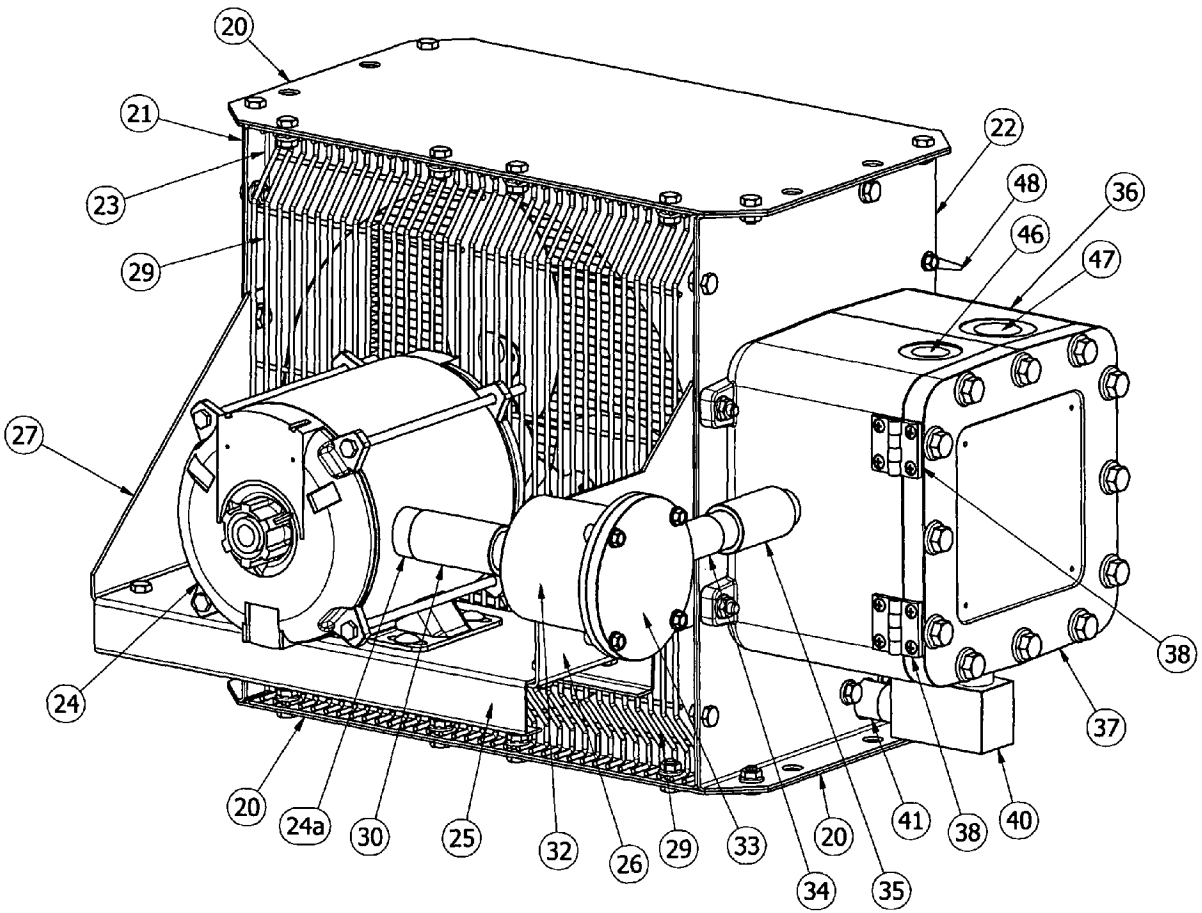
FIG. 10 is a perspective view from the rear side of a preferred embodiment of the present invention.

The explosion proof enclosure box 36 may house, but is not limited to housing, the following components as per FIGS. 1 and 2: A disconnect switch 1, an electronic control circuit 9, with a built in time monitoring device 18, a solid state relay 6, 7, an electric heating element current transformer device 5, an electric motor current transformer device 8, an audible device 12, a communication port 15, and an enclosure internal predetermined hi limit temperature monitoring device 16.

The explosion proof enclosure box 36 is covered off by an explosion proof enclosure cover 37 preferably constructed of a non-sparking metal that is preferably bolted-on and hinges on a preferably bolted-on hinging device 38.

An explosion proof expansion conduit union "C" represented by members 39, 40, 41, preferable manufactured from a non-sparking metal, whereby the explosion proof expansion conduit union member 39 preferably axially telescoping inside the explosion proof enclosure box 36 and is preferably threaded into explosion proof expansion conduit union member 40 The explosion proof expansion conduit union member 41 preferably axially telescopes inside the explosion proof expansion conduit member 40 and preferably threads into the heat exchanger 42.

The axially telescoping feature of the explosion proof expansion conduit unions "A", "B" and "C", is constructed preferably of an inner and outer conduit, preferably telescoping on an axial plane and preferably manufactured with a close tolerance fit forming an explosion proof conduit.

The explosion proof expansion conduit union members 30, 31, 34, 35, 39, 40, 41 simplify the installation process of the explosion proof expansion conduit unions "A", "B" and "C" and ensures the conduit unions can expand and retract in the event of thermally induced stresses in the conduits or the like thereof.

The explosion proof expansion conduit union members 30, 31, 34, 35 form an explosion proof protective conduit allowing electrical wires 75*a*, 75*b* as per FIGS. 1 and 2 from the explosion proof electric motor 25, to pass through the explosion proof junction box 32 and be terminated in the explosion proof enclosure box 36. The explosion proof expansion conduit union members 39, 40, 41 form a protective conduit allowing electrical wires 76*a*, 76*b*, 77, 78 as per FIGS. 1 and 2 from the heat exchanger 42 to pass through and be terminated in the explosion proof enclosure box 36.

An integral disconnect switch handle 43 preferably operating the integral disconnect switch 1 as per FIGS. 1 and 2. Switch handle 44 preferably operating switch 14 as per FIGS. 1 and 2 providing the "automatic on" selection mode or "continuous on" selection mode for the explosion proof electric motor 24, and an illuminating device 45 preferably providing a predetermined sequenced blinking to relay the safety mechanisms are preferably mounted on the outside of the explosion proof enclosure box 36. The switching mechanism of the integral disconnect switching handle 43 is preferably mounted on the inside of the explosion proof enclosure box 36. The switching mechanism of switch handle 44 is preferably mounted on the inside of the explosion proof enclosure box 36. The illuminating device mechanism of the illumination device 45 is preferably mounted on the inside of the explosion proof enclosure box 36.

Entry 46 represents a preferable auxiliary entrance, while entry 47 represents a preferable primary power entrance.

A louver 48 preferably constructed of non-sparking material and preferably fastened to the right side panel 21 and left side panel 22, provides the ability to direct the air exiting through the exhaust opening 73 and into the atmosphere.

Figure 11:
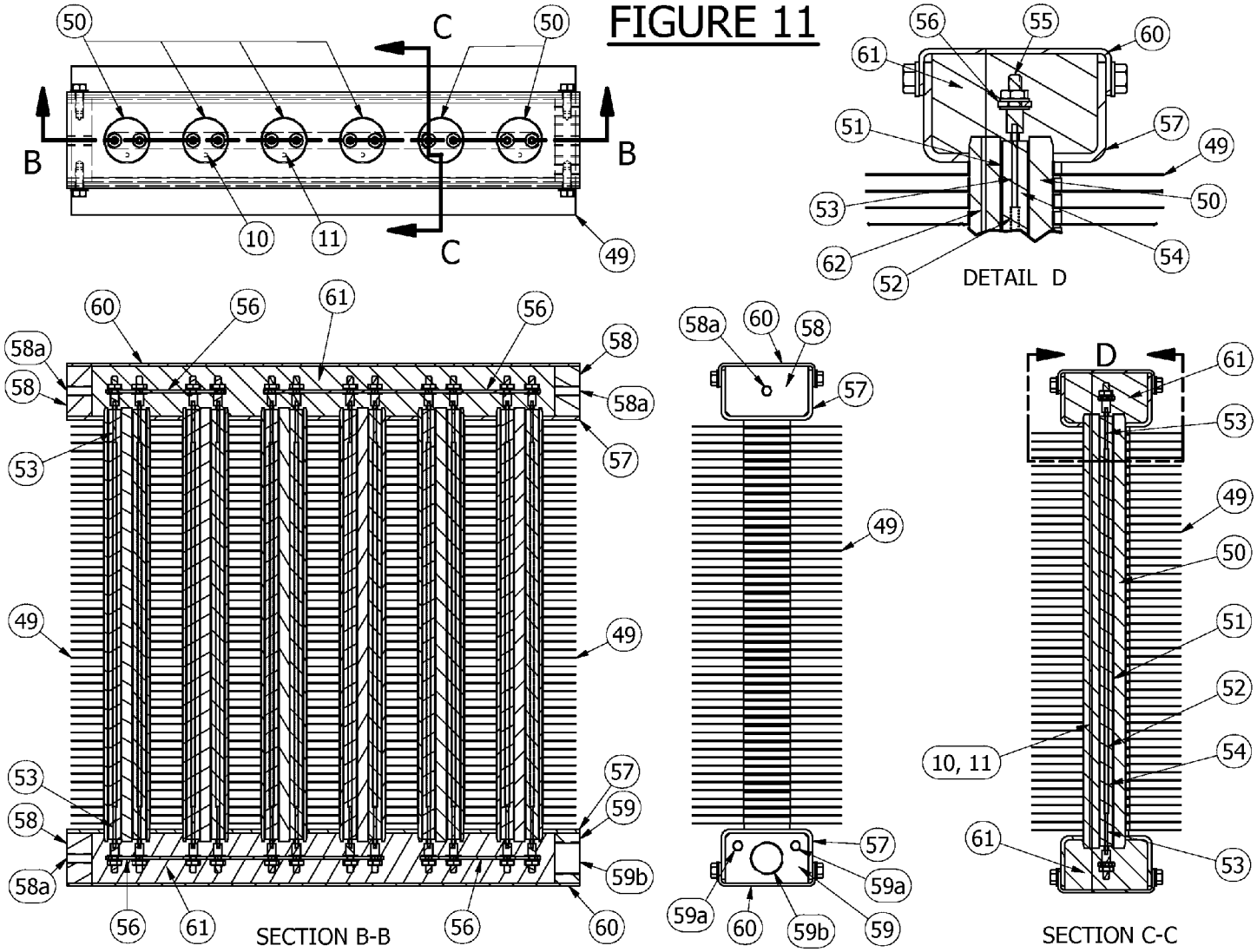
FIG. 11 is an illustration of a preferred embodiment of the heat exchanger of the present invention.

FIG. 11 illustrates a preferable breakdown of the heat exchanger 42 used in the current invention. A fin 49, preferably formed from a heat conductive metal, is preferably press fit onto preferably manufactured similar heat conductive metal tubes 50 that preferably have an electric heating element 74 as per FIGS. 1 and 2 inserted within the body of the tube. The electric heating element 74 as per FIGS. 1 and 2 is preferably made according to conventional construction and includes: a tubular metal sheath 51, a resistor coil 52, and a cold pin 53. The cold pin 53 is housed within the metal sheath and compacted granular refractory material 54 within the sheath, to electrically insulate the coil from the sheath and conduct heat from the coil to the sheath. A fastening terminal 55, preferably manufactured from an electric conductive metal, is preferably crimped onto the cold pin 53 and provides a connection between the bus bar 56, preferably manufactured from an electric conductive metal, and the consecutive electric heating elements. A header 57, preferably formed of a heat conductive sheet metal, is preferably press fit onto the metal tubes 50. The header 57 is preferably enclosed by a header end plate 58 with a preferable threaded fastener provision 58*a*, a header end plate 59 with a preferable fastener provision 59*a*, and a threaded electric conduit entrance provision 59*b*.

The components 50, 57, 58, 59, and header cover 60 preferably manufactured of a heat conductive metal are preferably fastened together with a threaded fastener and form the header assembly.

The header assembly forms an internal void 61, which is preferably filled with a preferably electric resistant and preferably heat conductive encapsulation compound. The encapsulation compound is poured within the header assembly and hardens as the encapsulation compound cures. Once cured, the encapsulation compound forms a hard and resilient substance that replaces the need for a bulky explosion proof enclosure and provides a protective hazardous area barrier. (For bulky explosion proof enclosure example see prior art U.S. Pat. No. 4,117,308, items 72, 73, 82 and 83) An operating temperature monitoring device 10 and temperature hi limit monitoring device 11 are preferably mounted in one of the metal tubes 50 within a pre-manufactured cavity 62.

Figure 12:
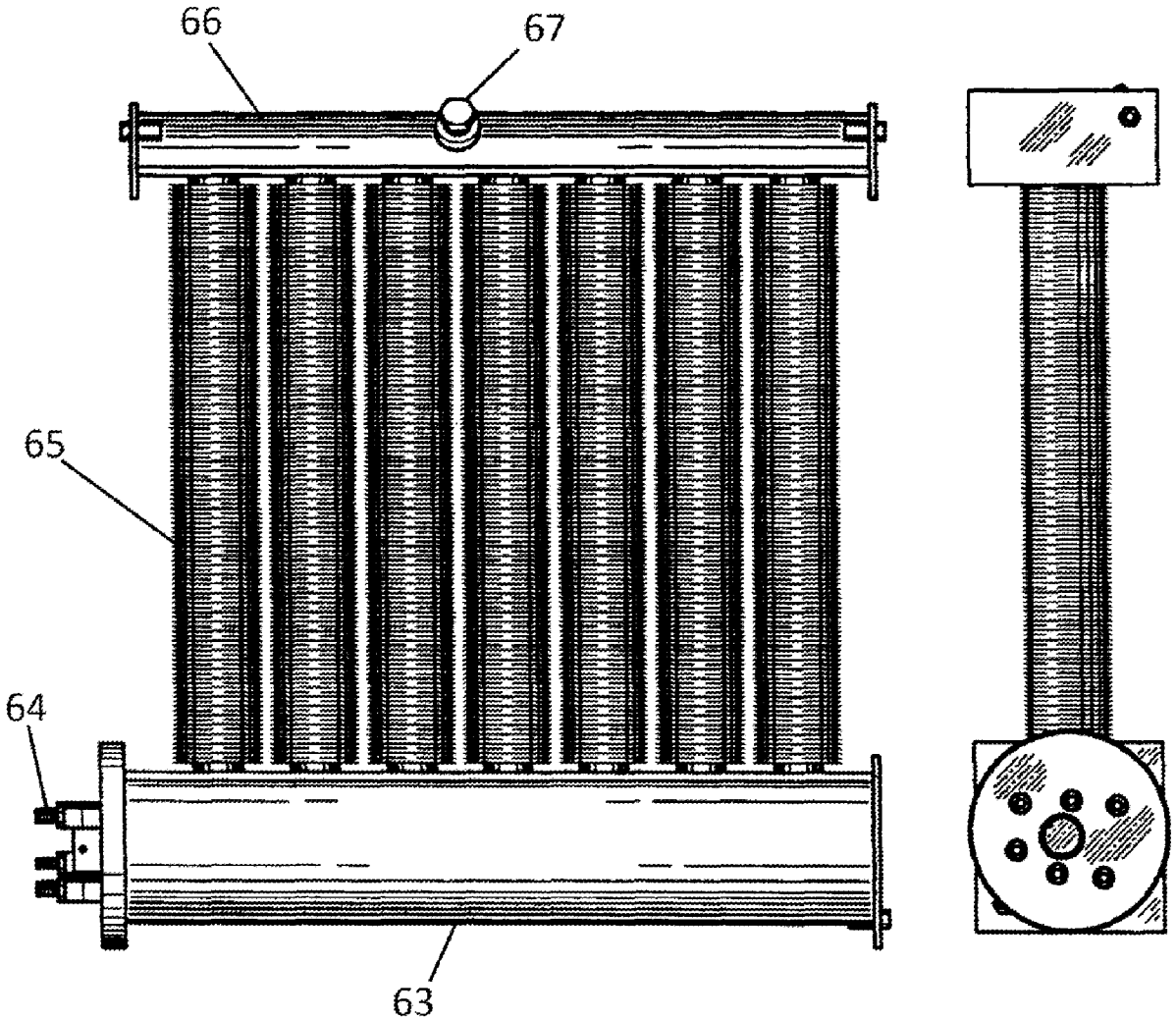
FIG. 12 represents the front and side views from the prior art heat exchanger as per U.S. Pat. No. D 356,367.

FIG. 12 illustrates prior art. For reference see U.S. Pat. No. D 356,367. The prior art submerges electric heating elements 64 in a water glycol mixture within the bottom header 63. The metal tubes with spiral wound aluminum fins 65 form the heat transfer media and are connected to the bottom 64 and top header 66. The pressure safety device 67 provides an overpressure safety feature.

Figure 13:
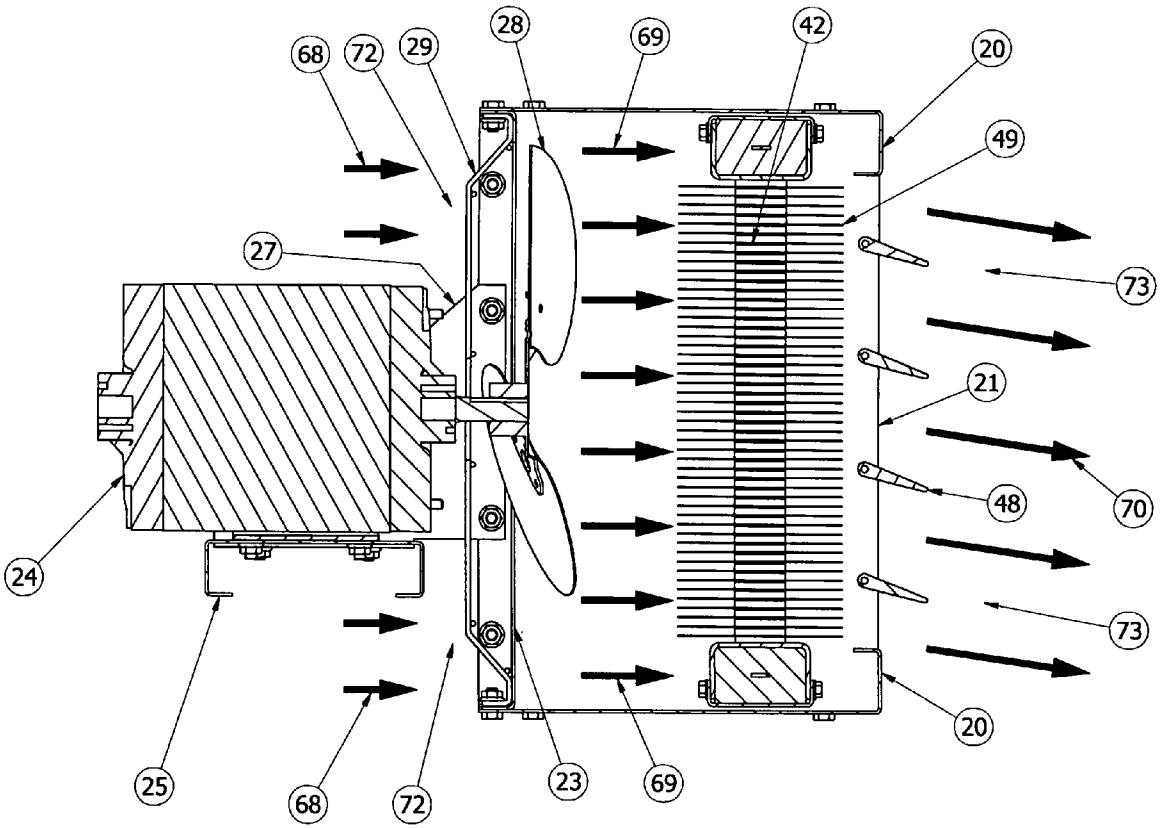
FIG. 13 is a cross-sectional view taken generally on line 13-13 of section A-A of FIG. 8 of the present invention and, FIG. 14 is an illustration of a preferred alternate embodiment of the heat exchanger showing the front and side views of the present invention.

FIG. 13 illustrates the air flow characteristics of the present invention. Cool air 68 is drawn into the intake opening 72 and into the heater cabinet via a preferred axial air mover 28. This accelerated cool air 69 is forced through the pre-heated heat exchanger 42. The heated fin 49 path causes the cool air 69 to heat up. As the air heats, it expands, creating a higher exit velocity 70. This acceleration event is caused by particular and specific fin spacing. If the fins spacing is too wide there is insufficient heating surface, which leads to less than sufficient air flow resistance to generate the forced air to heat up, thus failing to provide a sufficient exit temperature increase. If the fin spacing is too narrow the air flow is restricted, causing excessive air flow resistance. This resistance causes the cool forced air 69 to bulk up behind the heat exchanger 42, thus causing hot air to exit the heat exchanger 42 with substantially slower air velocity, thereby defeating the purpose of a forced air heater.

Figure 14:
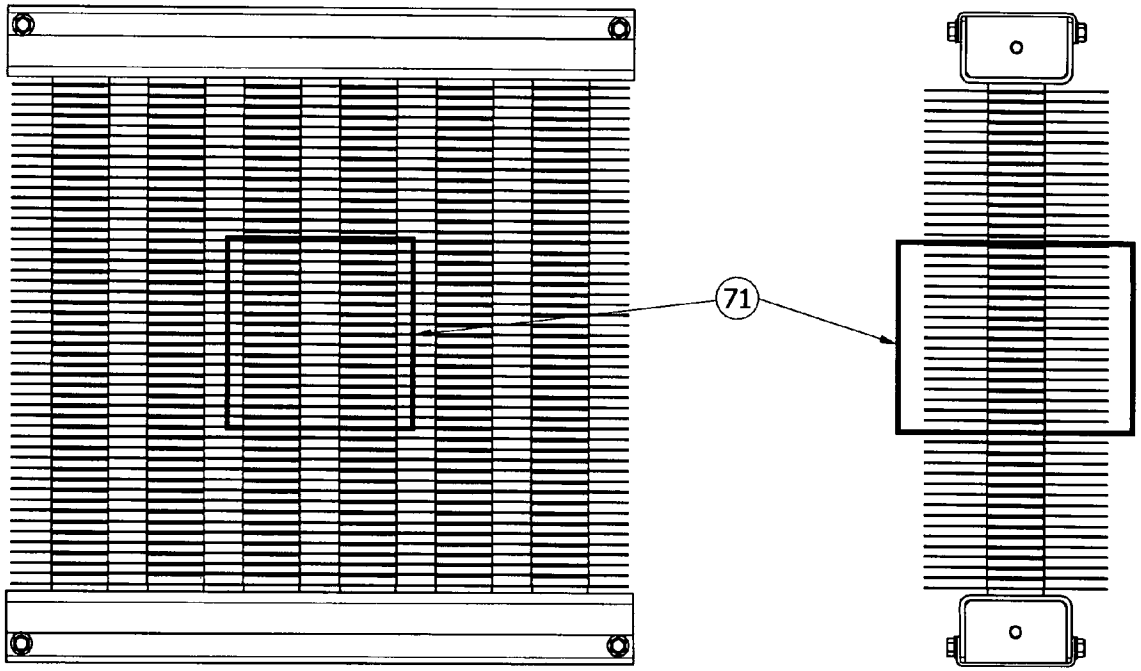

FIG. 14 illustrates an added feature of the heat exchanger 42 used in the present invention. The axial air mover 28 creates an area of decreased air movement in the center of the heat exchanger 42. Because the center of the axial air mover is incapable of producing air movement, a hot spot could occur within the heat exchanger 42, as represented by the highlighted perimeter 71. To eliminate the potential for a hot spot and premature resistor coil 52 burnout, the resistor coil 52 mounted in the electrical heating element 74 as per FIGS. 1 and 2 within the highlighted perimeter 71 is substituted with a specific coil design that elicits a cooler heating area within the electrical heating element creating a cooler heat source. The cooler heating area eliminates the hotspot scenario, while simultaneously conserving energy by ensuring areas incapable of heat dispersion remain cool during the heating cycle.

Although the invention has been described in connection with a preferred embodiment it should be understood that various modifications, additions and alterations may be made to the invention by one skilled in the art without departing from the spirit and scope of the invention as defined in the appended claims.

The embodiments of the invention in which an exclusive property or privilege is claimed are defined as follows:

1. An electric forced air heater particularly adapted to heat air in a hazardous area, comprising:

a rectangular sheet metal cabinet having at least one intake opening through which air may be drawn and at least one exhaust opening through which heated air may be discharged;

at least one explosion proof electric motor driven axial air mover for drawing air axially through at least one intake opening and discharging heated air axially through said at least one exhaust opening;

at least one heat exchanger vertically mounted within said sheet metal cabinet to heat air drawn through said at least one intake opening, each of said at least one heat exchanger being formed of heat conducting metal tubes and fins having electric heating elements, an operating temperature monitoring device, and a predetermined hi limit temperature monitoring device inserted therein;

said heat exchanger having electrical wires passing through a metal formed explosion proof expansion conduit union "C", entering a metal formed explosion proof enclosure box, said metal formed explosion proof enclosure box housing potential explosion causing devices;

said at least one explosion proof electric motor having said electrical wires passing through a metal formed explosion proof expansion conduit union "A", passing through a metal formed explosion proof junction box and passing through a metal formed explosion proof expansion conduit union "B", entering said metal formed explosion proof enclosure box;

a multitude of louvers mounted to said sheet metal cabinet and positioned horizontally across said exhaust opening to direct discharged air.

2. Said at least one heat exchanger as claimed in claim 1 further comprising: headers press fit on said metal tubes, said headers flanked by header ends and covered with a header cover, forming an internal void, said internal void containing the electric heating element fastening terminals, said electric heating elements and said electric heating element fastening terminals connected via a bus bar embedded in an encapsulation compound, said encapsulation compound once cured, providing a protective hazardous area barrier.

3. Said encapsulation compound of claim 2 being of an electric insulating and heat conductive compound.

4. At least one heat exchanger as claimed in claim 2 exhibiting a cooler area in the center of said at least one heat exchanger, where axial airflow is limited from said axial air mover, said cooler area created by the use of a cooler heating source in the said cooler area within said electric heating elements.

5. Said operating temperature monitoring device as claimed in claim 1 monitoring the operating temperature of said at least one heat exchanger.

6. Said predetermined hi limit temperature monitoring device as claimed in claim 1 monitoring the predetermined hi limit shutdown temperature of said at least one heat exchanger.

7. Said metal formed explosion proof enclosure box as claimed in claim 1 further comprising:

an electronic control circuit monitoring and controlling:

pre programmed heating cycles, said at least one explosion proof electric motor, said electric heating elements, operating temperature of said at least one heat exchanger, said predetermined hi limit temperature of said at least one heat exchanger, the operating time of said electric heating elements, a predetermined hi limit internal temperature, the triggering of safety mechanisms, and relaying of said safety mechanisms events;

a solid state relay controlling said at least one explosion proof electric motor;

a solid state relay controlling said electric heating elements;

an electric motor current transformer device monitoring the current of said at least one explosion proof electric motor;

an electric heating element current transformer device monitoring the current of said electric heating elements;

an enclosure internal predetermined hi limit temperature monitoring device, monitoring said predetermined hi limit internal temperature of said metal formed explosion proof enclosure box;

an audible beeping device relaying said safety mechanisms events;

a visual illumination device relaying said safety mechanisms events;

a communications port communicating with said electronic control circuit;

a thermostatic switch connection provision;

a switch selecting either an "automatic on" or "continuous on" mode to provide controllability of said at least one explosion proof electric motor;

an integral disconnect switch to disconnect power to all above said components.

8. The solid state relay of claim 7 can also be substituted for an electrical mechanical relay.

9. The communications port of claim 7 further comprising:

communication between the end user and said electronic control circuit;

remotely operating of said electric forced air heater;

a computer interface for uploading heating cycle software and testing of said heating cycle software.

10. Said preprogrammed heating cycles of claim 7 further comprising:

a heating cycle wherein said electronic control circuit receives a demand for heat signal, momentarily switching said solid state relay and engaging said at least one explosion proof electric motor with said axial air mover to determine the working condition of said at least one explosion proof electric motor, by transmitting a signal from said electric motor current transformer device to said electronic control circuit, wherein said at least one explosion proof electric motor is continuously monitored by said electric motor current transformer device through transmitting a signal to said electronic control circuit;

said electronic control circuit, engaging said electric heating elements within said at least one heat exchanger by switching said solid state relay to start a preheat cycle, wherein said at least one heat exchanger is continuously monitored by said electric heating element current transformer device by transmitting a signal to said electronic control circuit;

said operating temperature monitoring device which monitors the operating temperature of said electric heating elements within said at least one heat exchanger until a predetermined preheat temperature, wherein said at least one explosion proof electric motor of said axial air mover is engaged by switching said solid state relay, forcing cool air through said electric heating elements within said at least one heat exchanger and pushing heated air into the atmosphere until the demand for heat has been met and said electronic control circuit disengages said solid state relay, disengaging the power leading to said electric heating elements within said at least one heat exchanger, allowing said at least one explosion proof electric motor to remain engaged and said axial air mover operating until said at least one heat exchanger has cooled to a predetermined set temperature, as monitored by said temperature monitoring device, completing said heating cycle.

11. Said heating cycle as claimed in claim 10 including an elevated ambient temperature scenario comprising:

an oscillating cycle occurring during said elevated ambient temperature scenario which triggers said at least one heat exchanger to reach said predetermined hi limit temperature and shutdown prior to reaching the demanded ambient temperature, wherein said electronic control circuit automatically triggers said oscillating cycle, where the said at least one heat exchanger temperature cycles between a predetermined upper and lower temperature limit, monitored by said operating temperature monitoring device until said demanded temperature has been met, completing said heating cycle.

12. The electronic control circuit of claim 7 wherein said safety mechanisms provide a safety shutdown of said electric forced air heater by disengaging the power leading to said at least one explosion proof electric motor and said electric heating elements, when triggered by an event comprising:

an automatic shutdown when said electronic control circuit does not register a predetermined electrical current value from said electric motor current transformer device prior to said preheat cycle of said at least one heat exchanger due to failure of said at least one explosion proof electric motor, said electric motor current transformer device, or said solid state relay;

an automatic shutdown when said electronic control circuit does not register a predetermined electric current from said electric motor current transformer device of said at least one heat exchanger during said heat cycle due to failure of said at least one explosion proof electric motor, said electric motor current transformer device, or said solid state relay;

an automatic shut down when said electronic control circuit does not register a predetermined electrical current from said electric heating element current transformer device due to failure of said electric heating element, said electric heating element current transformer device, or said solid state relay;

an automatic shutdown when said electronic control circuit does not register a signal from said operating temperature monitoring device due to failure of said operating temperature monitoring device;

an automatic shutdown when said electronic control circuit does not register a signal from said predetermined hi limit safety temperature monitoring device due to failure of said predetermined hi limit safety temperature monitoring device;

an automatic shutdown when said electronic control circuit registers a signal from said predetermined hi limit safety temperature monitoring device indicating said at least one heat exchanger has met said predetermined hi limit temperature and is overheating;

an automatic shutdown when said electronic control circuit does not register a signal from said enclosure internal predetermined hi limit temperature monitoring device due to failure of said enclosure internal predetermined hi limit safety temperature monitoring device;

an automatic shutdown when said electronic control circuit registers a signal from said enclosure internal predetermined hi limit safety temperature monitoring device indicating said metal formed explosion proof enclosure box has met said enclosure internal predetermined hi limit temperature and is overheating.

13. The electronic control circuit of claim 7 wherein said safety mechanisms elicit the relaying of an audible or visual signal to the operator by providing a predetermined sequenced beep from said audible beeping device, or a predetermined blinking sequence from said visual illumination device.

14. Said switch of claim 7 wherein the switch handle is mounted on the outside of said metal formed explosion proof enclosure box and the switching mechanism is mounted on the inside of said metal formed explosion proof enclosure box.

15. Said switch of claim 7 wherein said "automatic on" selection mode signals said at least one explosion proof electric motor with said axial air mover to operate according to said preprogrammed heating cycles.

16. Said switch of claim 7 wherein said "continuous on" selection mode signals said at least one explosion proof electric motor with said axial air mover to operate continuously, strictly providing air movement as part of a cooling cycle.

17. Said integral disconnect switch of claim 7 wherein the integral disconnect switch handle is mounted on the outside of said metal formed explosion proof enclosure box and the switching mechanism is mounted on the inside of said metal formed explosion proof enclosure box.

18. Said metal formed explosion proof junction box of claim 1 further comprising an optional thermostatic switch.

19. The axial air mover of claim 1 wherein said axial air mover can be substituted with any type of air mover.

20. Said metal formed explosion proof expansion conduit unions "A", "B" and "C" of claim 1 wherein said metal formed explosion proof expansion conduit unions comprise: an inner and outer conduit telescoping on an axial plane, allowing for close tolerance fit, forming an explosion proof conduit.

* * * * *